US008769892B2

(12) United States Patent
Molfetta

(10) Patent No.: US 8,769,892 B2
(45) Date of Patent: Jul. 8, 2014

(54) BUILDING STRUCTURE PROVIDED WITH VERTICAL WALLS COMPRISING A THERMOPLASTIC POLYMER

(75) Inventor: Angelo Molfetta, Vasto (IT)

(73) Assignee: Aurea S.r.l., Montesilvano (PE)

( * ) Notice: Subject to any disclaimer, the term of this patent is extended or adjusted under 35 U.S.C. 154(b) by 26 days.

(21) Appl. No.: 12/998,755

(22) PCT Filed: Nov. 19, 2009

(86) PCT No.: PCT/EP2009/065496

§ 371 (c)(1),
(2), (4) Date: May 27, 2011

(87) PCT Pub. No.: WO2010/060857

PCT Pub. Date: Jun. 3, 2010

(65) Prior Publication Data

US 2011/0225914 A1 Sep. 22, 2011

(30) Foreign Application Priority Data

Nov. 27, 2008 (IT) ..... MO2008A0305

(51) Int. Cl.
*E04H 1/00* (2006.01)

(52) U.S. Cl.
USPC ..... 52/236.9; 52/281

(58) Field of Classification Search
CPC ..... E04C 2/288; E04C 2/049; E04B 2/845; E04B 2001/2454
USPC ..... 52/309.1, 236.9, 281, 285.1, 309.12, 52/712
See application file for complete search history.

(56) References Cited

U.S. PATENT DOCUMENTS

| | | | | |
|---|---|---|---|---|
| 2,131,465 | A * | 9/1938 | Levy | 52/347 |
| 3,665,662 | A * | 5/1972 | Timbrook et al. | 52/210 |
| 4,489,530 | A | 12/1984 | Chang | |
| 4,669,240 | A * | 6/1987 | Amormino | 52/236.6 |
| 5,335,472 | A | 8/1994 | Phillips | |
| 5,596,853 | A * | 1/1997 | Blaney et al. | 52/223.7 |
| 6,256,960 | B1 * | 7/2001 | Babcock et al. | 52/592.1 |
| 7,100,336 | B2 * | 9/2006 | Messenger et al. | 52/309.17 |
| 2007/0245640 | A1 | 10/2007 | Bergqvist | |

FOREIGN PATENT DOCUMENTS

| | | | |
|---|---|---|---|
| FR | 2 545 126 | A1 | 11/1984 |
| WO | WO 98/50646 | A1 | 11/1998 |
| WO | WO 02/31276 | A1 | 4/2002 |

* cited by examiner

*Primary Examiner* — Branon Painter
(74) *Attorney, Agent, or Firm* — Modiano & Associati; Albert Josif; Daniel J. O'Byrne

(57) ABSTRACT

A building structure provided with lateral walls comprising a thermoplastic polymer, which comprises: a plurality of vertical walls which are arranged on a plurality of levels, each of which walls comprises at least one first substantially continuous central panel made of a thermoplastic polymer and a pair of layers of cement plaster which are arranged on the opposite sides of the corresponding first central panel and form the opposite faces of the corresponding vertical wall, and a metallic structure for connecting at least the vertical walls of each one of the levels of the building structure.

10 Claims, 11 Drawing Sheets

BUILDING STRUCTURE PROVIDED WITH VERTICAL WALLS COMPRISING A THERMOPLASTIC POLYMER

The present invention relates to a building structure provided with vertical walls which comprise a thermoplastic polymer.

BACKGROUND OF THE INVENTION

It is known that ordinary dwellings, i.e., dwellings provided by using ordinary building materials such as reinforced concrete or bricks, have considerable drawbacks.

The most significant drawbacks consist in long construction times (often several months), in complicated building methods, in the high cost of the raw materials used, in limited resistance to seismic events, in limited heat retention and in high production and purchase cost.

In order to obviate these drawbacks, building structures have been devised whose walls comprise panels made of expanded polystyrene.

An example of a building structure provided by using walls of this type is disclosed in U.S. Pat. No. 6,519,904.

More particularly, U.S. Pat. No. 6,519,904 discloses a method for building load-bearing walls of building structures. Such walls comprise an insulating panel which is arranged within a metallic containment structure, inside which concrete is poured.

The concrete thus poured forms a load-bearing layer of considerable thickness, which rests on the insulating panel.

The concrete layer forms the outer face of the corresponding wall, whereas the insulating panel is directed toward the internal face of the wall.

The concrete layer, inside which a wire mesh and stiffening bars are immersed, interrupts in some regions the insulating panel, thus creating discontinuities at which vertical load-bearing columns are provided.

The containment structure consists of containment elements which are substantially C-shaped and arranged with respect to each other so as to form a rectangular closed profile. The vertically arranged containment elements are provided with a plurality of through slots which the concrete enters, anchoring itself to the containment structure.

Building structures provided by using the building method disclosed in U.S. Pat. No. 6,519,904 are not free from drawbacks, which include the fact that the stiffness of the structure is provided exclusively by the layer of reinforced concrete, and therefore the insulating panels have no structural function and accordingly do not contribute to the absorption of the stresses to which the corresponding wall can be subjected. Walls thus provided, therefore, have a static behavior that is fully analogous to commonly used concrete walls. Further, the behavior of these walls under dynamic stresses is not uniform over their entire extension and in particular on their opposite faces due to their non-symmetrical structure.

Moreover, U.S. Pat. No. 6,519,904 does not disclose how the various walls which constitute an entire residential building are mutually connected and therefore in which way the stresses that act on the building structure thus provided are distributed.

Another drawback of building structures of this type consists in the long construction times that they require, which are also due to the considerable use of concrete.

SUMMARY OF THE INVENTION

The aim of the present invention is to eliminate the drawbacks cited above of the background art, by providing a building structure provided with vertical walls which comprise at least one panel made of thermoplastic material, in which all the elements that constitute the vertical walls contribute to absorb the stresses that act on them.

Within this aim, an object of the present invention is to provide a building structure all the vertical walls of which cooperate with each other to absorb the stresses that act on the building structure.

Another object is to provide a building structure whose vertical walls have a substantially uniform behavior with respect to stresses on both of their outermost faces.

Another object of the present invention is to devise a building structure that can be provided in significantly shorter times than those required for building structures of the known type and can be modified during construction very simply and flexibly by the use of elements which are easily available and easy to manufacture and transport.

Another object of the present invention is to allow high energy saving, high resistance to external stresses and, last but not least, significantly lower construction costs than known types of building structures.

Another object of the present invention is to provide a structure which is simple, relatively easy to provide in practice, safe to use, effective in operation, and has relatively low costs.

This aim and these and other objects which will become better apparent hereinafter are achieved by the present building structure provided with lateral walls comprising a thermoplastic polymer, characterized in that it comprises:

- a plurality of vertical walls which are arranged on multiple levels, each wall comprising at least one first substantially continuous central panel made of a thermoplastic polymer and a pair of layers of cement plaster which are arranged on the opposite sides of the corresponding first central panel and form the opposite faces of the corresponding vertical wall; the vertical walls of the lowest level being fixed in a lower region to a reference plane and the vertical walls of each level being mutually connected in order to delimit one or more closed perimeters;
- at least one covering wall, which is fixed in an upper region to the vertical walls of each one of said levels in order to form one or more closed volumes and to mutually separate said levels, the covering wall of the highest level forming the roof of said building structure;
- a metallic structure for connecting at least the vertical walls of each one of said levels.

BRIEF DESCRIPTION OF THE DRAWINGS

Further characteristics and advantages of the present invention will become better apparent from the following detailed description of a preferred but not exclusive embodiment of a building structure provided with vertical walls comprising at least one thermoplastic polymer, illustrated by way of non-limiting example in the accompanying drawings, wherein.

DESCRIPTION OF THE PREFERRED EMBODIMENTS

Figure 1:
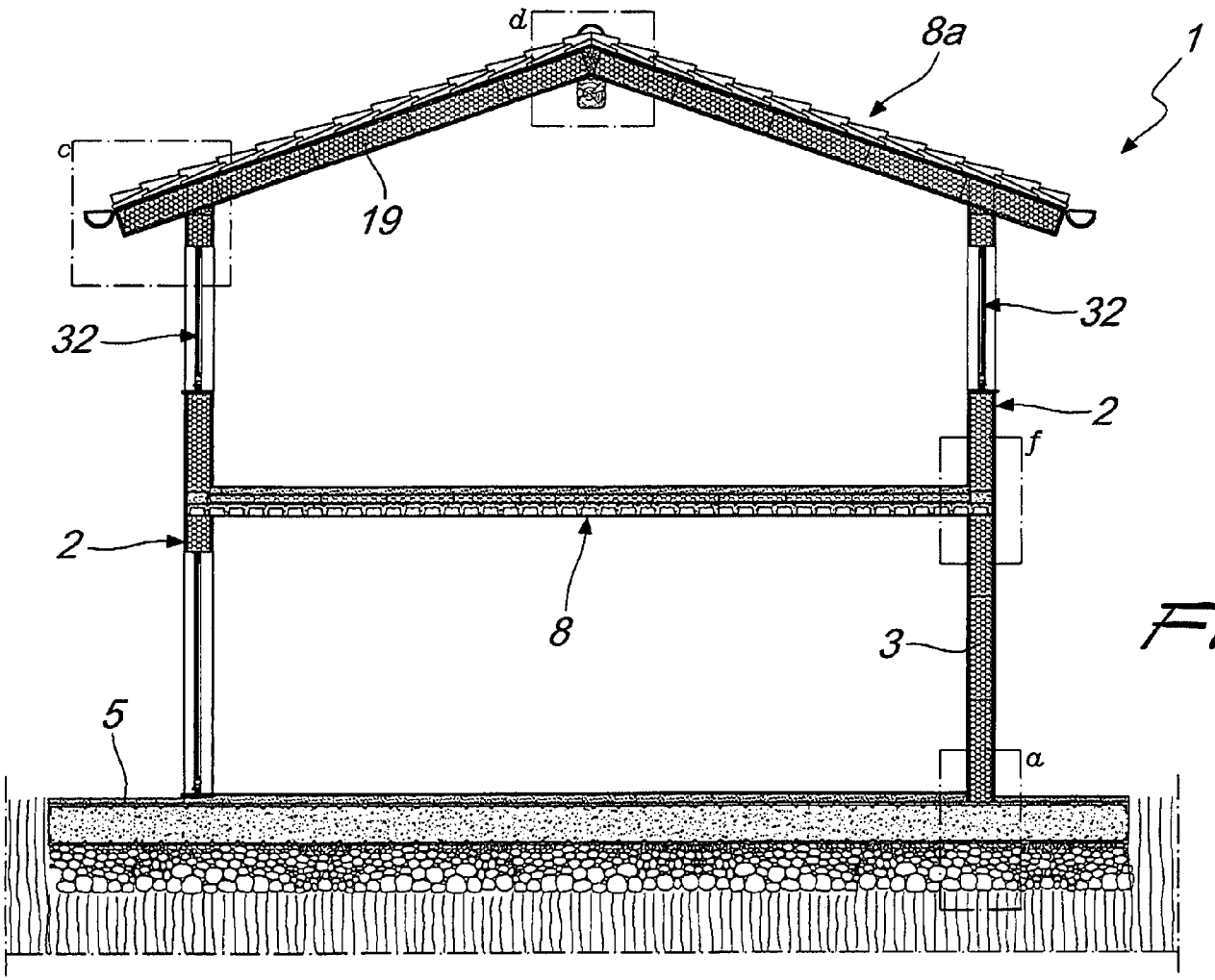
FIG. 1 is a side elevation view of a building structure according to the invention, taken along a vertical sectional plane.

With reference to the figures, the reference numeral 1 generally designates a building structure according to the invention.

According to the invention, the building structure 1 comprises a plurality of vertical walls 2 which are arranged on multiple levels, where the term "levels" is understood to mean the planes arranged at mutually different heights within the building structure.

Each vertical wall 2 comprises at least one first central panel 3 which is substantially continuous and made of a thermoplastic polymer, preferably polystyrene, and two layers 4 of cement plaster which are arranged on the opposite sides of the corresponding panel 3 and form the opposite faces of the corresponding vertical wall 2.

The vertical walls 2 of the lowest level (i.e., of the ground floor) of the building structure 1 are fixed in a lower region to a reference plane 5 which is made for example of concrete.

More particularly, the vertical walls 2 of the lowest level are fixed to the reference plane 5 by means of a plurality of threaded elements 6, which engage a metallic plate 7 that is arranged so as to rest on said reference plane.

The vertical walls 2 of each level are mutually connected so as to delimit one or more closed perimeters.

Moreover, the building structure 1 comprises at least one covering wall 8, which is fixed in an upper region with respect to the vertical walls 2 of each level to form one or more closed volumes and mutually separate the levels themselves of the building structure 1. The covering wall of the topmost level forms the roof 8*a* of the building structure 1.

According to the invention, the building structure 1 further comprises a metallic structure 50 for connecting at least the vertical walls 2 of each level.

Advantageously, the metallic structure 50 comprises, for each vertical wall 2, a pair of first wire meshes 9, which are mutually jointly associated by means of metallic connectors 10 and are interposed between the sides of the corresponding first panel 3 and each one of the corresponding layers 4 of plaster.

Preferably, the first wire meshes 9 directed toward the incident faces of two mutually connected vertical walls 2 are mutually jointly associated, for example by soldering their lateral ends.

The metallic structure 50 further comprises, for each one of the vertical walls 2, at least one pair of first metallic vertical elements 11*a*, which are C-shaped and substantially without discontinuities, are arranged at the lateral ends of the corresponding vertical walls 2, and form a receptacle for a lateral end of the corresponding first panel 3. The first vertical elements 11*a*, consisting for example of profiles made of metal plate, have an elongated shape and the corresponding receptacle extends vertically.

Preferably, the metallic structure 50 also comprises, for each vertical wall 2, a first metallic horizontal element 11*b*, which is C-shaped and substantially without discontinuities, is arranged at the upper end of the corresponding vertical wall 2, and is fitted in an upper region to the corresponding first panel 3. The first horizontal elements 11*b*, consisting for example of profiles made of metal plate, have an elongated shape, and the corresponding receptacle extends horizontally.

Conveniently, the first vertical elements 11*a* and horizontal elements 11*b* are jointly associated with at least one of the first wire meshes 9 of the corresponding vertical wall 2.

Advantageously, the first vertical elements 11*a* of two vertical walls 2 that are mutually connected at the respective lateral ends are jointly associated with each other, for example by soldering.

In the case of vertical walls 2 characterized by a horizontal extension that is significantly larger than the vertical one, the corresponding first panel 3 is separated vertically into two parts, at the lateral ends of each of which two first vertical elements 11*a* are arranged. The first vertical elements 11*a* arranged at the separation region of the first panel 3 are mutually opposite and are jointly associated with each other.

Figure 11:
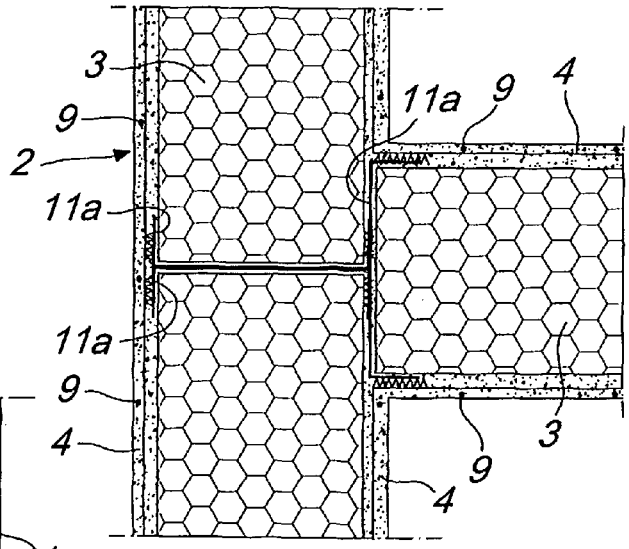
FIG. 11 is an enlarged scale view of the detail "m" of FIG. 9.
Figure 12:
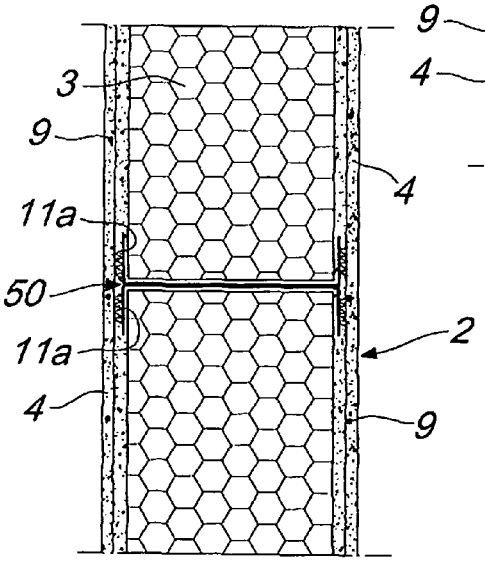
FIG. 12 is an enlarged-scale view of the detail "o" of FIG. 9.
Figure 14:
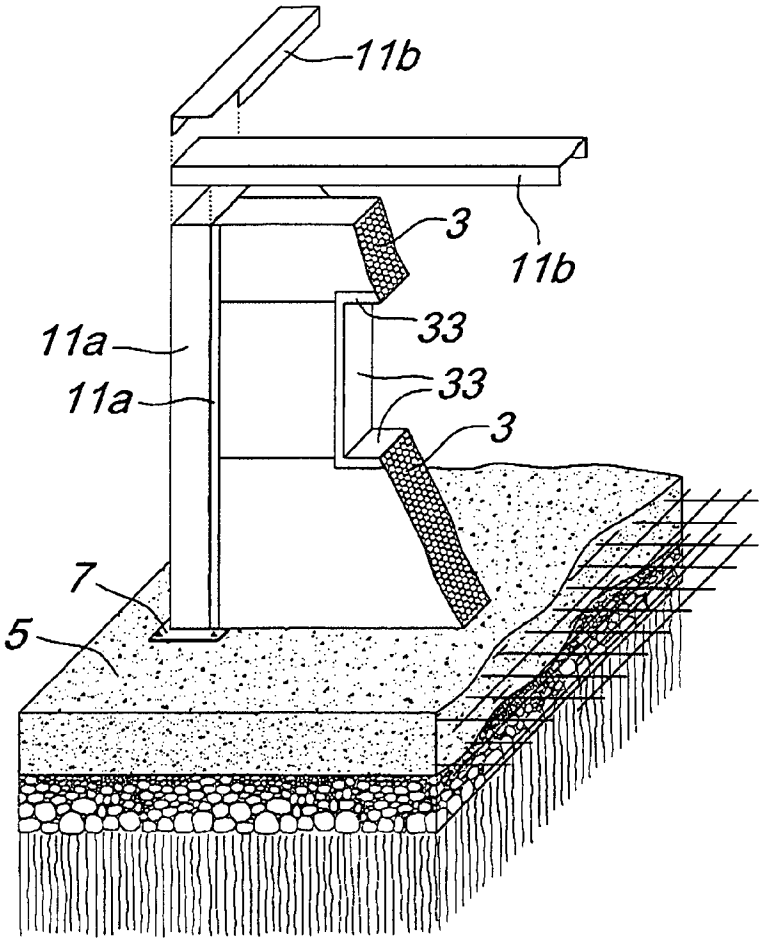
FIG. 14 is a view of the step for positioning two first horizontal elements on a corresponding first panel made of thermoplastic polymer.
Figure 13:
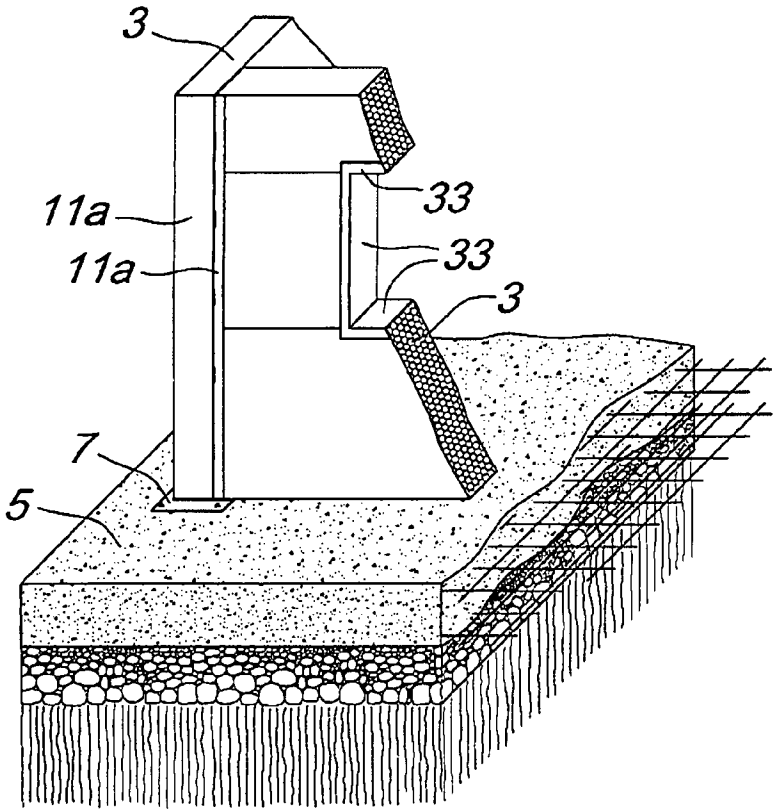
FIG. 13 is a view of a step for building a vertical wall according to the invention.
Figure 18:
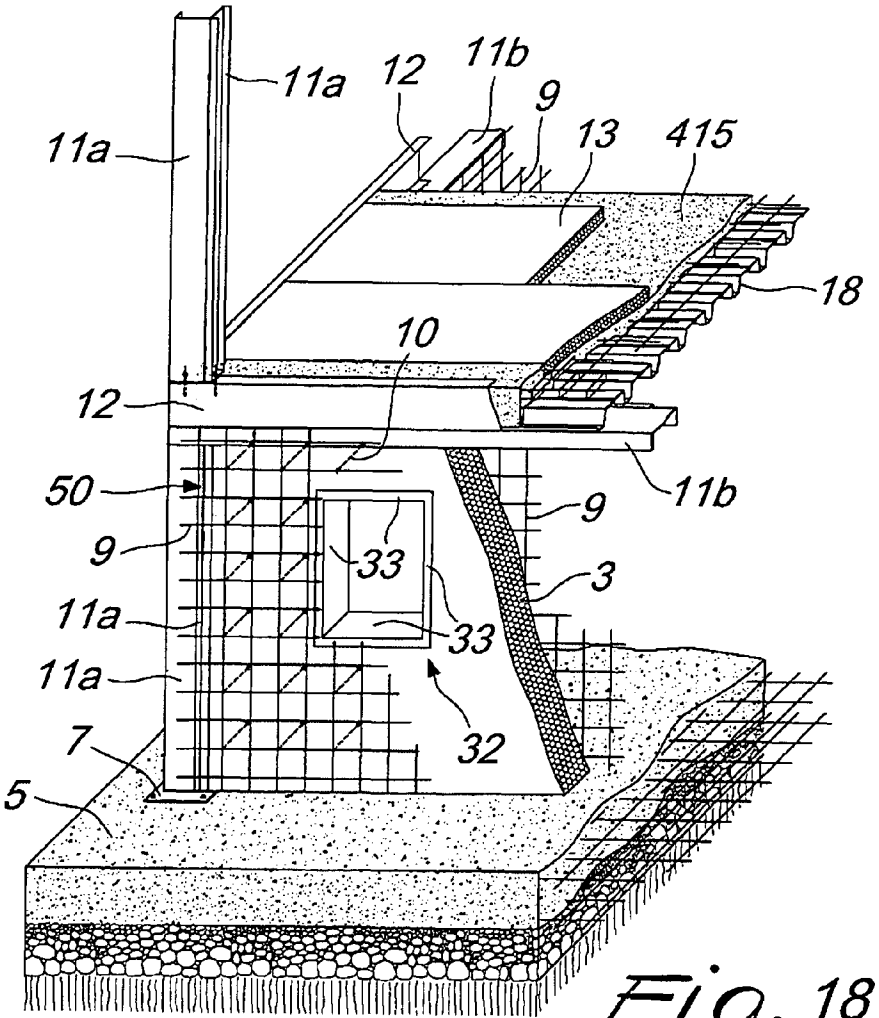
FIG. 18 is a view of the step for positioning and fixing the first vertical elements related to the vertical walls of the first level.
Figure 15:
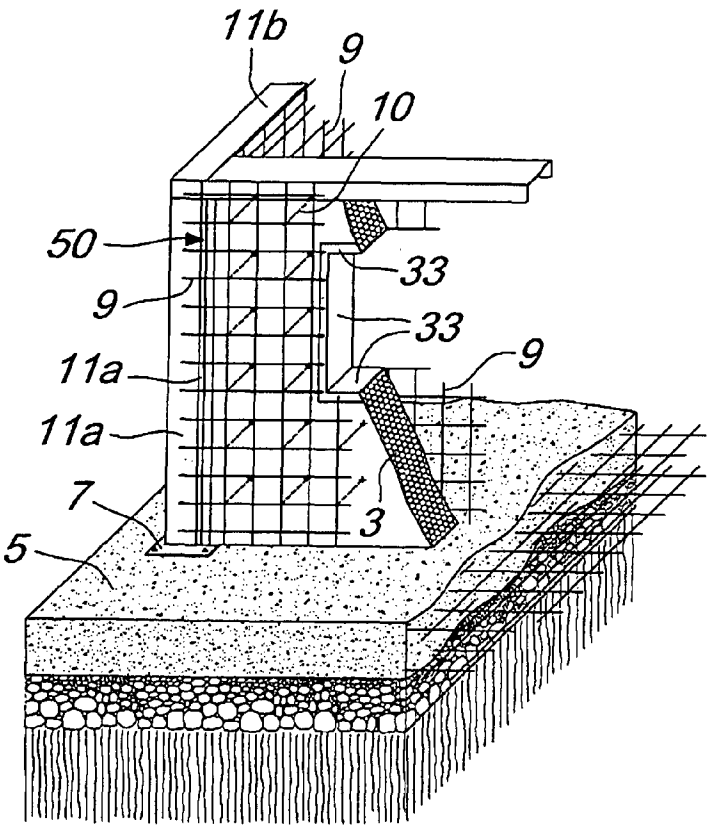
FIG. 15 is a view of the step for positioning some first wire meshes on the first panel of FIG. 14.
Figure 17:
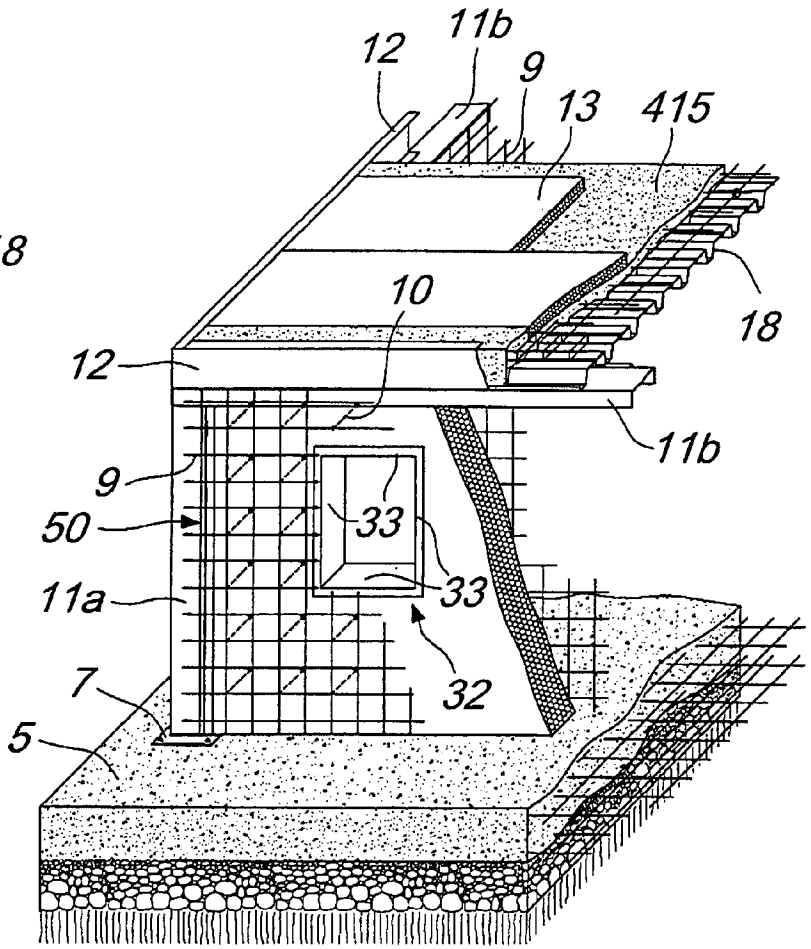
FIG. 17 is a view of the step for providing the wall for covering the lowest level of the building structure according to the invention.

In the case of a vertical wall 2*a* which is connected at one of its lateral ends to a face of another vertical wall 2*b*, the latter comprises, at the connection region, two first vertical elements 11*a* which are mutually opposite and are connected to the first vertical element 11*a* arranged at the incident lateral end of the vertical wall 2*a*, as shown in FIG. 11.

Figure 16:
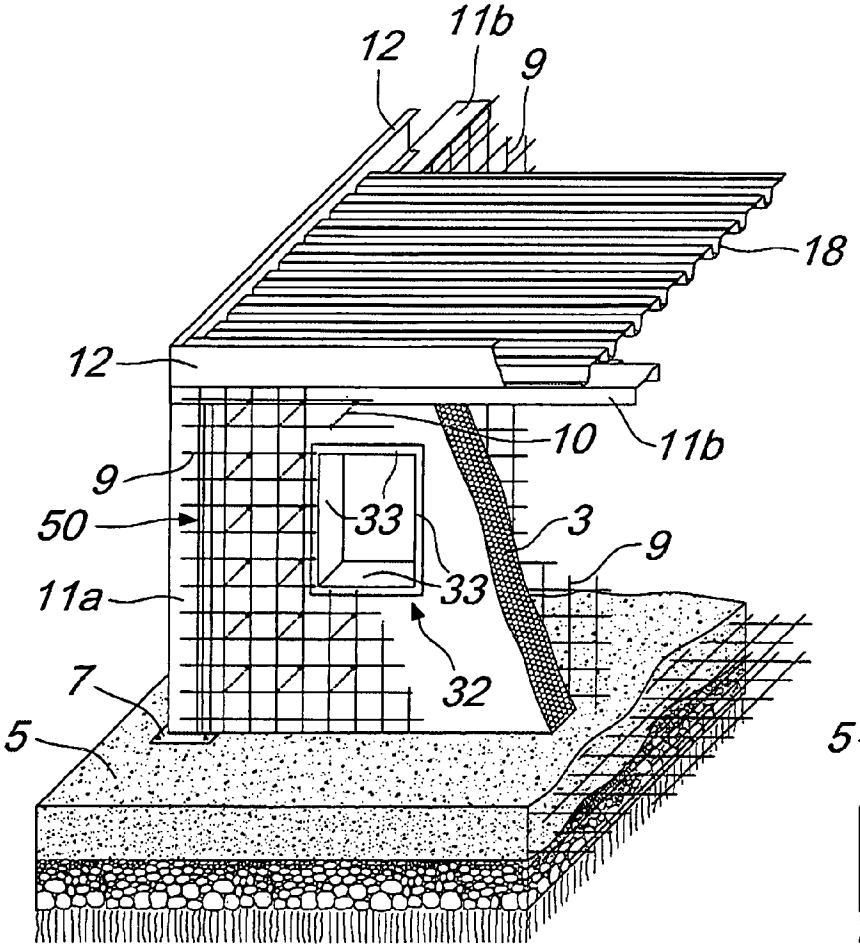
FIG. 16 is a view of the step for positioning the second horizontal elements on the first horizontal elements of FIG. 15 and of the corresponding corrugated plate.
Figure 19:
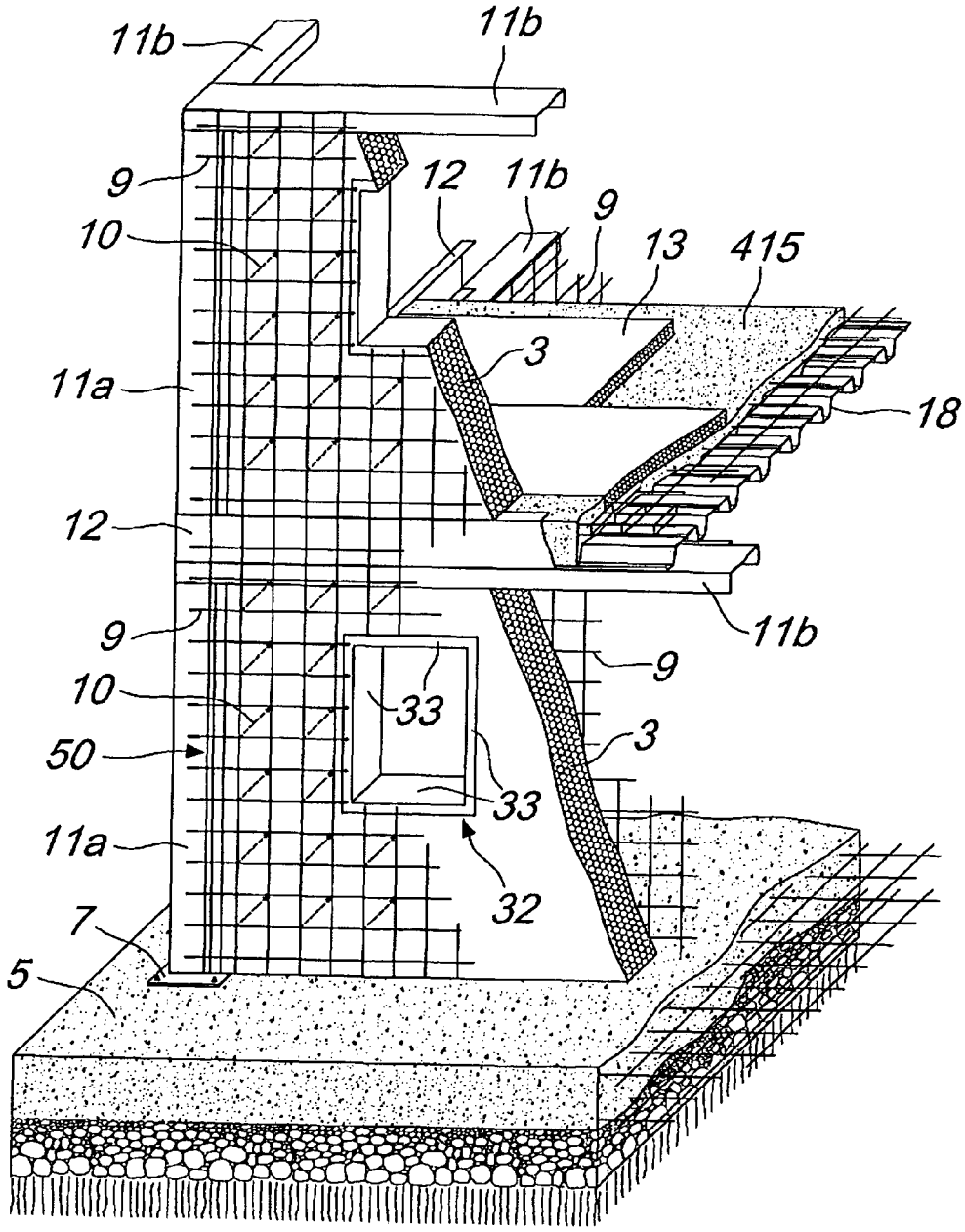
FIG. 19 is a view of the step for positioning the first panels of thermoplastic polymer and the first meshes related to the vertical walls of the first level of the building structure according to the invention.

The metallic structure 50 further comprises, for each level of the building structure 1, a plurality of second horizontal metallic elements 12, which are C-shaped and substantially without discontinuities and are mutually jointly associated so as to form a closed profile and a seat for containment of the corresponding covering wall 8, as shown in FIG. 16.

Advantageously, the second horizontal elements 12 that form the containment seat of the covering wall 8 are jointly associated at least with the first horizontal elements 11*b* of the vertical walls 2 that are arranged below the corresponding covering wall 8 and the first vertical elements 11*a* of the vertical walls 2 which are arranged in an upper region with respect to said covering wall.

Preferably, the first wire meshes 9 directed toward the faces of the vertical walls 2 of the various levels of the building structure 1 that delimit externally said building structure are jointly associated with each other.

Figure 5:
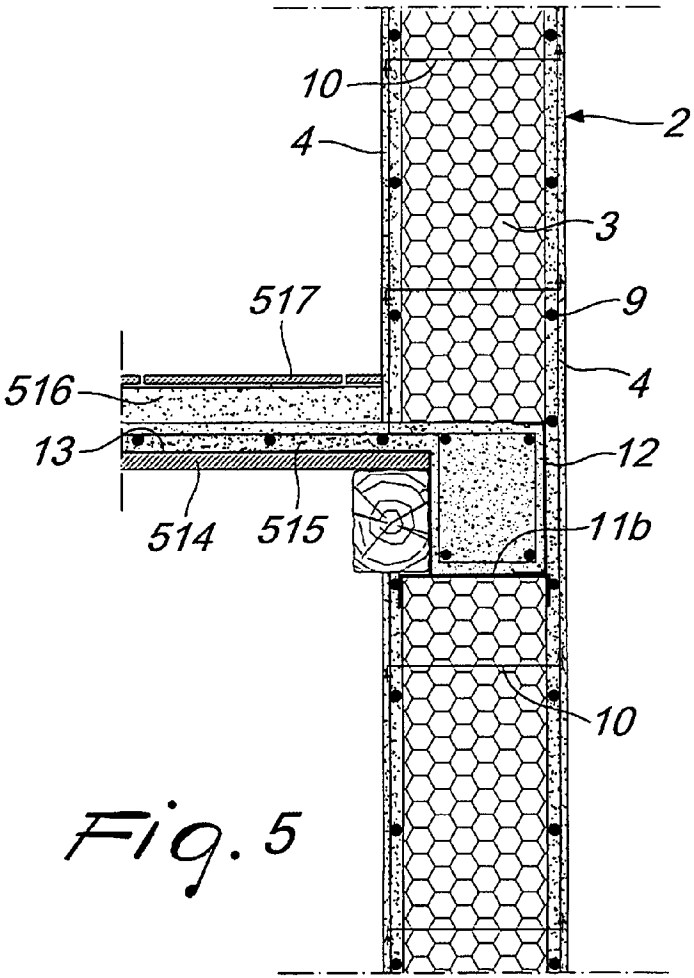
FIG. 5 illustrates a second embodiment of the detail "f" of FIG. 4.
Figure 4:
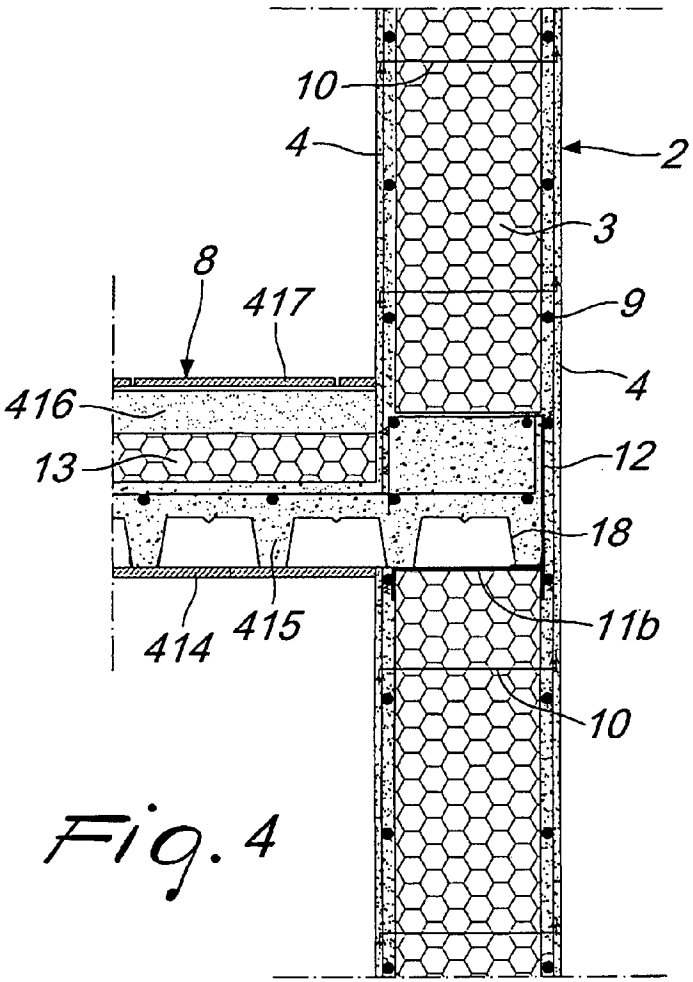
FIG. 4 is an enlarged-scale view of the detail "f" of the connection between the covering wall of FIG. 1 and a vertical wall.
Figure 6:
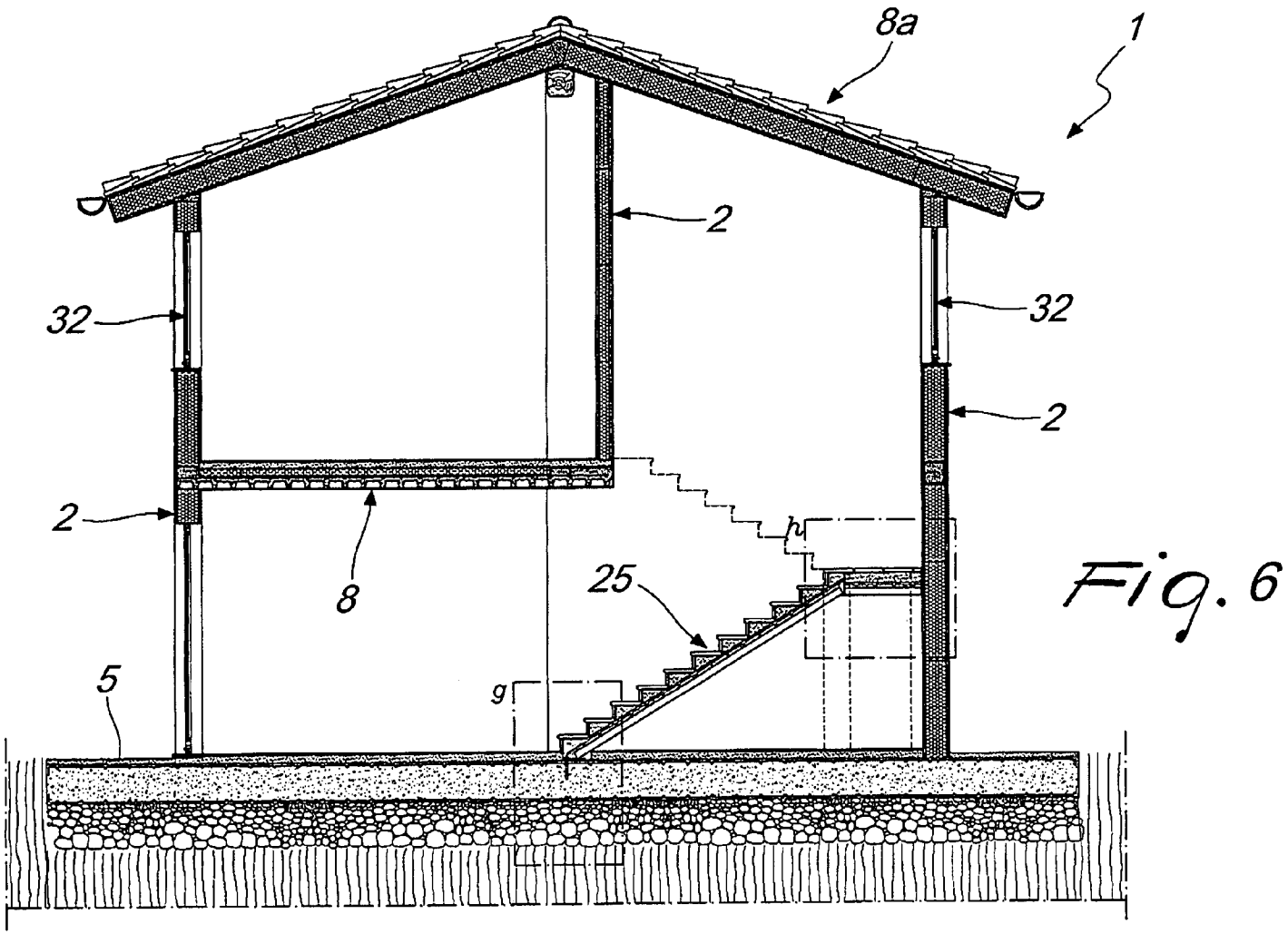
FIG. 6 is a side elevation view, taken along a vertical sectional plane, of the building structure according to the invention, which comprises a staircase.
Figure 8:
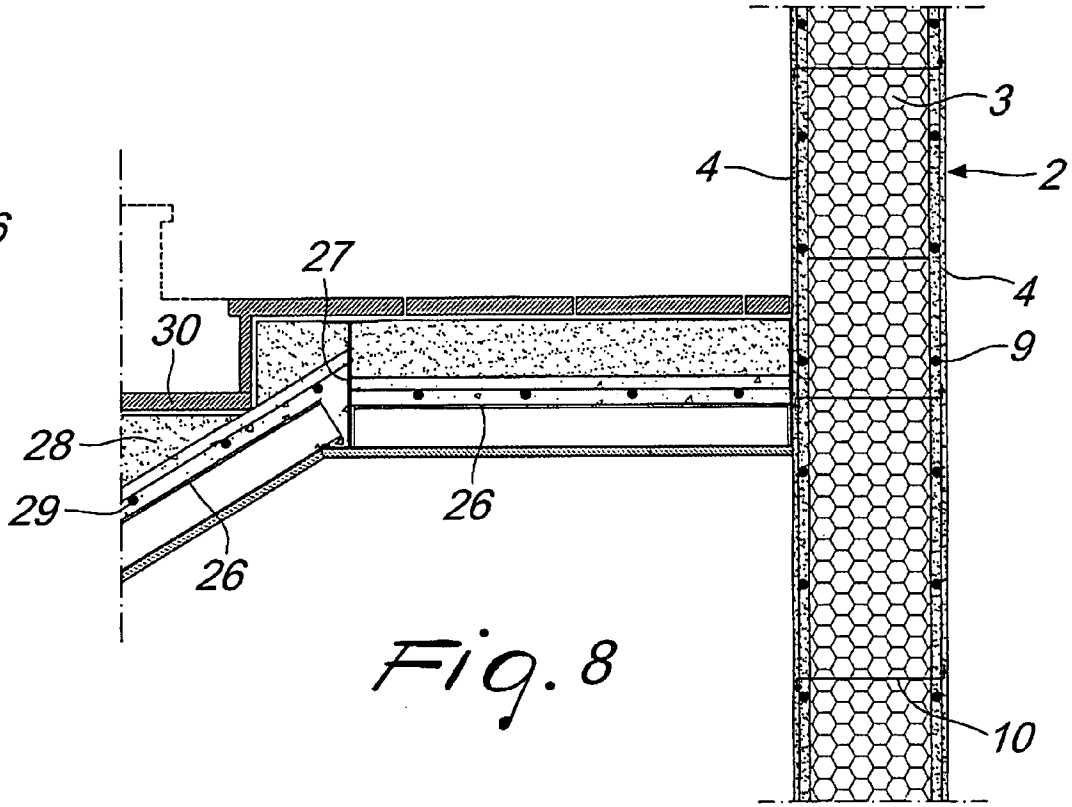
FIG. 8 is an enlarged-scale view of the detail "h" of the staircase of FIG. 6.
Figure 7:
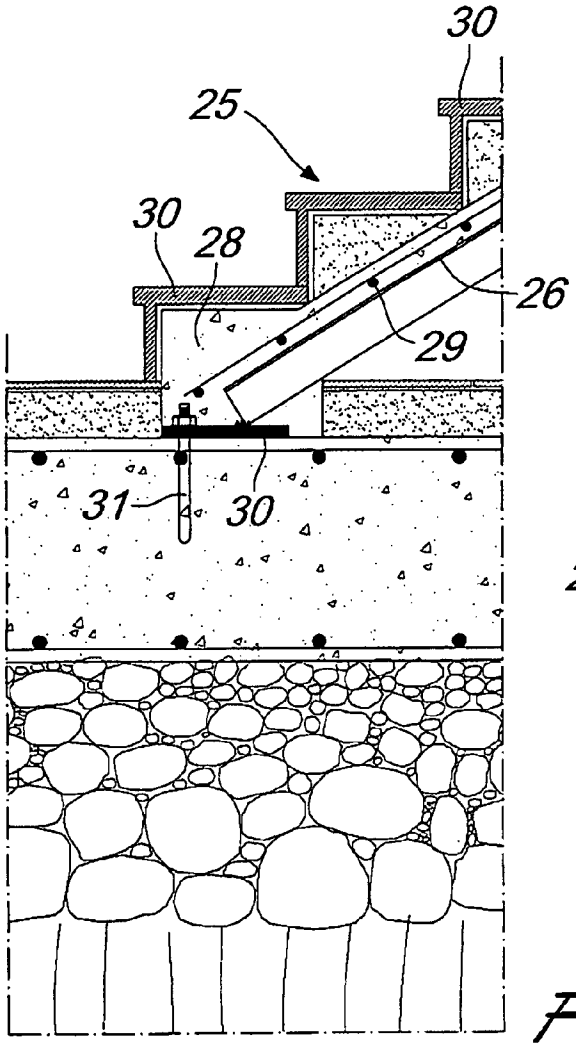
FIG. 7 is an enlarged-scale view of the detail "g" of the staircase of FIG. 6.
Figure 9:
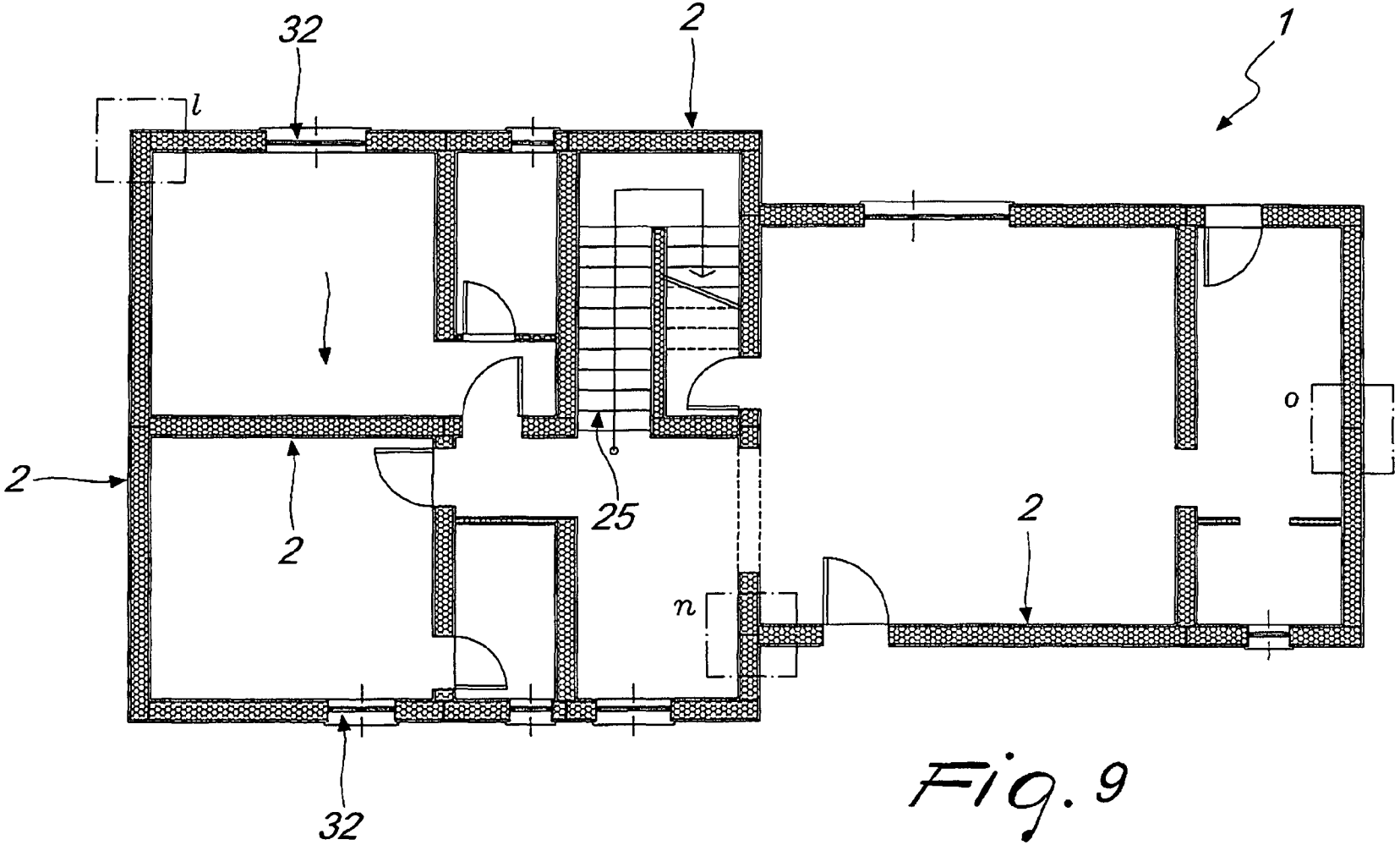
FIG. 9 is a top plan view of the building structure according to the invention.
Figure 10:
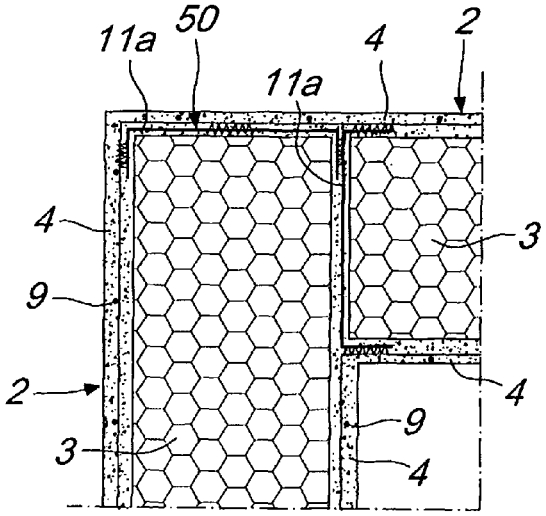
FIG. 10 is an enlarged-scale view of the detail "l" of FIG. 9.

Conveniently, the covering walls 8 of the intermediate levels, i.e., excluding the roof 8*a*, also comprise a layer of polystyrene 13 and can be provided in various manners, as shown in FIGS. 4 and 5 (the first digit of the reference numerals relating to the elements that are common to the two embodiments described hereinafter identifies the corresponding figure).

The embodiment shown in FIG. 4 has a deck 414, which delimits in a lower region the corresponding covering wall 8, consisting for example of ceiling panels, on which a corrugated plate 18 is arranged which is covered with a reinforced concrete screed 415, which acts as support for the layer of polystyrene 13. A foundation 416 of sand and cement is provided over the polystyrene layer 13, and the floor 417 is positioned thereon.

The embodiment shown in FIG. 5 instead has a slab-like deck 514, which consists for example of wood panels, on which the layer of polystyrene 13 in sheet form is positioned, a reinforced concrete screed 515 arranged on top of the layer of polystyrene 13, and a foundation 516 of sand and cement, over which the floor 517 is positioned.

Different embodiments of the covering walls 8 are in any case not excluded.

Figure 3:
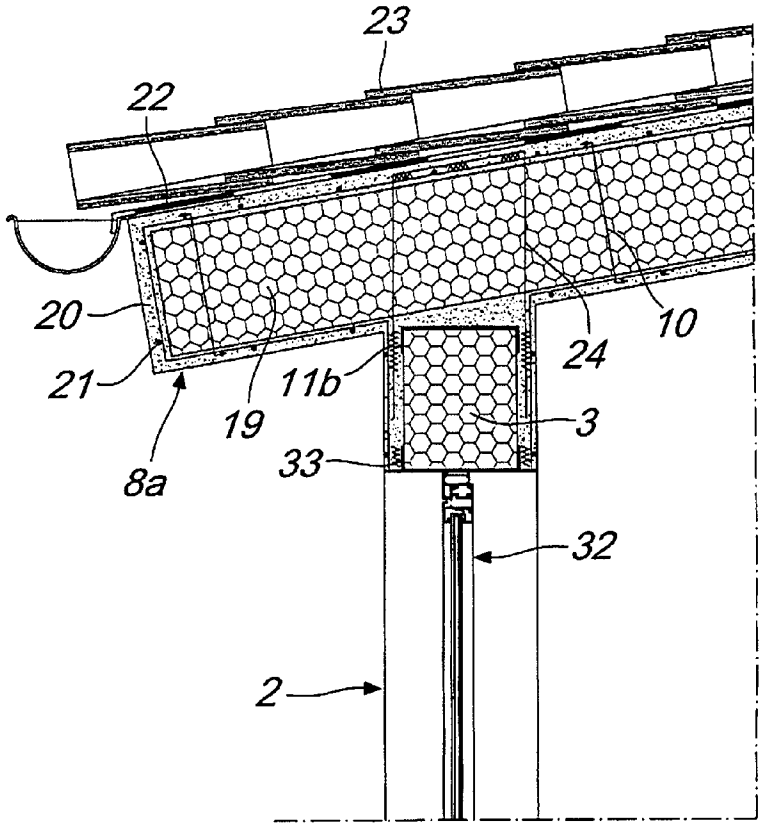
FIG. 3 is an enlarged-scale view of the detail "c" of FIG. 1.
Figure 2:
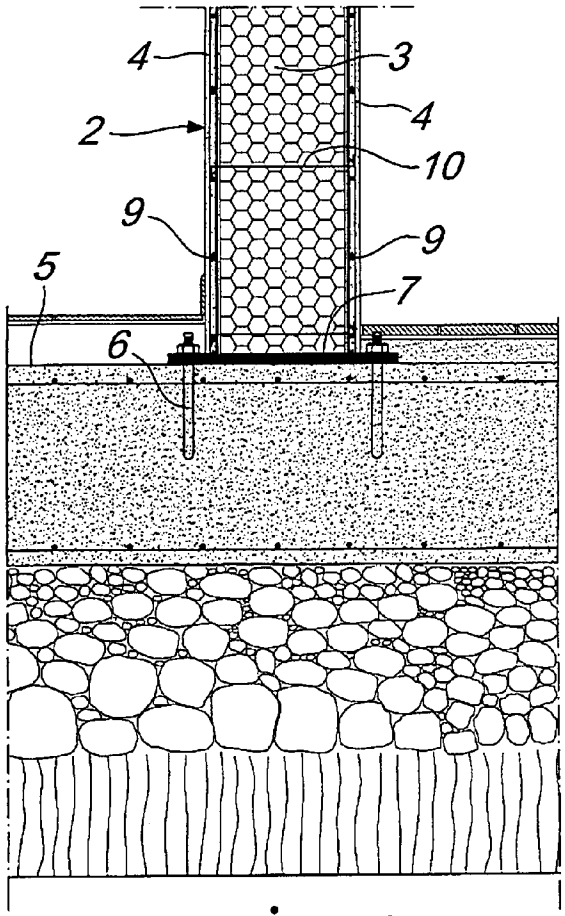
FIG. 2 is an enlarged-scale side view of the detail "a" of FIG. 1.

Preferably, the roof 8*a* of the building structure 1, shown in cross-section in FIG. 3, comprises a pair of second panels 19 made of thermoplastic polymer, which are mutually inclined and around which a reinforced concrete border 20 is provided. A second wire mesh 21 is arranged inside the border 20 and surrounds the entire profile of the corresponding panel 3.

Advantageously, the metallic structure 50 comprises means, for example a metal bracket 24, for fixing the second wire mesh 21 of the roof 8*a* to at least one of the first wire meshes 9 of the vertical walls 2 which are connected in a lower region with respect to the roof.

The roof 8*a* is covered in an upper region by a waterproofing membrane 22 and by a covering layer 23.

Preferably, the building structure 1 also comprises one or more staircases 25 for connection between two distinct levels.

Each staircase 25 comprises a metallic load-bearing structure, which consists for example of a corrugated plate 26 which is self-supporting and jointly associated, at its upper end, with a C-shaped metal profile 27 which is arranged horizontally. A support 28 made of concrete is formed above the corrugated plate 26 and contains a metallic reinforcement frame 29, and the steps 30 are fixed thereto.

The lower end of the corrugated plate 26, which forms the load-bearing structure for the staircase 25 for connecting the lower level of the building structure 1 to the level directly above, is jointly associated with a plate 40, which in turn is connected to the reference plane 5 by means of one or more threaded elements 31.

Advantageously, the vertical walls 2 can comprise one or more windows 32.

The windows 32 are delimited by a plurality of metallic containment elements 33, which are C-shaped and are mutually connected so as to form a closed profile. The receptacle formed by each containment element 33 is directed toward the outside of the corresponding window 32 and is fitted on the edge of the corresponding panel 3, which is conveniently contoured so as to form said window.

Each containment element 33 is jointly associated, for example by electric welding, with the first wire meshes 9, which are conveniently cut at the edge of the corresponding window 32, of the vertical wall 2 in which the window is provided.

The casings of the windows 32 are anchored jointly to the corresponding containment elements 33.

The method for providing a building structure according to the invention is as follows.

First of all, a plurality of first substantially continuous panels 3 made of a thermoplastic polymer and a plurality of first vertical elements 11*a*, each forming a corresponding receptacle for a lateral end of one of the first panels 11*a*, are provided.

The method according to the invention then provides for the alignment of the first vertical elements 11*a* in pairs so that the respective receptacles face each other to receive a corresponding first panel 3.

Subsequently, the first vertical elements 11*a* thus arranged are fixed to the reference plane 5 by means of the threaded elements 6.

Once the first vertical elements 11*a* have been fixed, a corresponding first panel 3 is arranged between each pair of first vertical elements 11*a* which are mutually aligned and face each other.

Conveniently, the first vertical elements 11*a* are arranged with respect to each other so that the corresponding first panels 3 form at least one substantially closed perimeter. More particularly, the first vertical elements 11*a* relating to the first panels 3, designed to form two mutually connected vertical walls 2, are arranged in mutual contact and fixed to each other.

Advantageously, after the positioning of each first panel 3, a first horizontal element 11*b* is applied to the corresponding upper edge of a first horizontal element 11*b*, which is also C-shaped and substantially without discontinuities and is fixed to the first wire meshes 9 of the corresponding first panel 3.

Then a pair of first wire meshes 9 is positioned at the opposite sides of each first panel and said first wire meshes are fixed to the first vertical elements 11*a* of the corresponding first panel 3.

Before positioning and fixing of the first wire meshes 9 it is possible to cut the corresponding first panel 3 in order to form one or more windows 32.

The method according to the invention then provides for the application of at least one layer 4 of cement plaster on each side of the first panels 3, at the corresponding first wire meshes 9, in order to form the faces of the vertical walls 2 of the building structure 1.

Conveniently, in the case of a building structure with a plurality of levels, after positioning and fixing the first wire meshes 9 of the vertical walls of the lowest level of the building structure 1, a plurality of second horizontal elements 12 is positioned on top of the corresponding first horizontal elements 11*b*.

The second horizontal elements 12, in practice rotated through 90° with respect to the first horizontal elements 11*b*, are arranged so as to form a closed profile and a seat for containment of the covering wall 8 of the corresponding level.

More particularly, in the embodiment shown in FIG. 16, after positioning and fixing at least two second horizontal elements 12 which are mutually contiguous, a corrugated plate 18 is arranged so that its perimetric edges enter the receptacles formed by each second horizontal element 12, and then the remaining second horizontal elements 12 also are positioned so as to close the corresponding profile.

Then the reinforced concrete screed 415 is provided, its thickness being greatest along the outside perimeter at the first horizontal elements 11*b* and being in any case contained within the receptacle formed by the corresponding second horizontal element 12, and the layer of polystyrene 13 is positioned.

Having thus provided the corresponding covering wall 8, one proceeds with the construction of the vertical walls 2 of the next level in a manner similar to what has just been described, with the difference that the corresponding first vertical elements 11*a* are fixed in a lower region, by means of additional threaded elements not visible in detail in the figures, to the corresponding second horizontal elements 12.

Advantageously, the first wire meshes 9 that are directed toward the faces of the vertical walls 2 of the various levels that externally delimit the building structure 1 and are mutually superimposed are then mutually jointly associated.

Once the positioning and fixing of the first wire meshes 9 of the vertical walls 2 of the various levels of the building structure 1 have thus been completed, one proceeds with the application of the layer 4 of plaster on the faces of the vertical walls 2 that externally delimit the building structure.

Once the vertical walls 2 of the highest level of the building structure 1 have thus been provided, the roof 8*a* is positioned and fixed.

In practice it has been found that the described invention achieves the proposed aim and objects and in particular the fact is stressed that the building structure thus provided is, with respect to known types of building structures, simple and quick to provide and highly resistant to external dynamic stresses, has a high heat efficiency, and has low costs.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements without thereby abandoning the scope of the protection of the appended claims.

The disclosures in Italian Patent Application No. MO2008A000305 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

What is claimed is:

1. A building structure provided with lateral walls comprising a thermoplastic polymer, consisting of:

a plurality of vertical walls which are arranged on a plurality of levels, each wall comprising at least one first substantially continuous central panel made of a thermoplastic polymer and a pair of layers of cement plaster which are arranged on the opposite sides of the corresponding first central panel and form opposite faces of the corresponding vertical wall; the vertical walls of the lowest level being fixed in a lower region to a reference plane and the vertical walls of each level being mutually connected for delimiting one or more closed perimeters;

at least one covering wall, which is fixed in an upper region to the vertical walls of each one of said levels in order to form one or more closed volumes and to mutually separate said levels, the covering wall of the highest level forming a roof of said building structure;

a metallic structure for connecting at least the vertical walls of each one of said levels;

said metallic structure comprising, for each one of said vertical walls, two first wire meshes, which are mutually jointly associated, each of which is interposed between one side of the corresponding first central panel and the corresponding layers of plaster; the first wire meshes directed toward the incident faces of two of said vertical walls which are mutually connected being jointly associated with each other;

said metallic structure comprising, for each one of said vertical walls, at least one pair of first metallic vertical elements, which are C-shaped and substantially without discontinuities, are arranged at the lateral ends of said vertical walls and form a receptacle for the corresponding first central panel;

said two first wire meshes being mutually jointly associated by means of metallic connectors that extends through said central panel.

2. The building structure according to claim 1, further comprising, for each one of said vertical walls, at least one first metallic horizontal element, which is C-shaped and substantially without discontinuities and is arranged at an upper end of a corresponding vertical wall and fitted in an upper region with respect to a corresponding first central panel.

3. The building structure according to claim 1, wherein said first vertical elements and horizontal elements are jointly associated with at least one of the first wire meshes of the corresponding vertical wall.

4. The building structure according to claim 1, wherein the first vertical elements of two of said vertical walls which are mutually connected at their respective lateral ends are jointly associated with each other.

5. The building structure according to claim 1, wherein said metallic structure comprises, for each one of said levels, a plurality of second horizontal elements, which are C-shaped and substantially without discontinuities and are mutually jointly associated so as to form a closed profile and a receptacle for containing the corresponding covering wall.

6. The building structure according to claim 5, wherein the second horizontal elements that form the containment seat of one of said covering walls are jointly associated with the first horizontal elements and with the first vertical elements of the vertical walls which are arranged respectively below and above the corresponding covering wall.

7. The building structure according to claim 1, wherein the vertical walls of said lowest level are fixed to said reference plane by means of threaded elements.

8. The building structure according to claim 1, wherein said roof comprises at least one second substantially continuous central panel made of a thermoplastic polymer and a border made of concrete, said border comprising at least one second wire mesh which surrounds said second central panel; said metallic structure comprising means for fixing said second wire mesh to at least one of the first wire meshes of the vertical walls which are connected in a lower region with respect to said roof.

9. The building structure according to claim 1, wherein the first wire meshes directed toward the faces of the vertical walls of said levels that externally delimit said building structure are jointly associated with each other.

10. The building structure according to claim 1, wherein said metallic connectors have ends that protrude from said central panel and are covered by said layers of cement plaster.

* * * * *